US011313646B1

(12) United States Patent
Simon

(10) Patent No.: US 11,313,646 B1
(45) Date of Patent: Apr. 26, 2022

(54) SLIDE HAVING REAR SIGHT FASTENER ASSEMBLY FOR PISTOLS

(71) Applicant: Kimber IP, LLC, Yonkers, NY (US)

(72) Inventor: John B. Simon, Troy, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 17/187,201

(22) Filed: Feb. 26, 2021

(51) Int. Cl.
*F41G 1/26* (2006.01)

(52) U.S. Cl.
CPC ..... *F41G 1/26* (2013.01)

(58) Field of Classification Search
CPC ..... F41G 1/26; F41G 1/06; F41G 1/16; F41G 1/17; F41G 1/18; F41G 1/20; F41G 11/002; F41G 11/004; F41G 11/001; F41G 11/003
USPC ..... 42/111
See application file for complete search history.

(56) References Cited

U.S. PATENT DOCUMENTS 3,750,319 A * 8/1973 Roy ..... F41A 17/64 42/70.08
4,658,529 A * 4/1987 Bertolini ..... F41A 17/64 42/70.08
8,413,363 B1 * 4/2013 Karfiol ..... F41A 11/00 42/106
10,024,628 B2 * 7/2018 Toner ..... F41G 1/16
2005/0229462 A1 * 10/2005 McGarry ..... F41A 17/02 42/70.08
2014/0165446 A1 * 6/2014 Rozic ..... F41G 1/02 42/111
2017/0059277 A1 3/2017 Justice

FOREIGN PATENT DOCUMENTS

BR 9001880 A * 11/1991 ..... F41A 17/30

* cited by examiner

*Primary Examiner* — John Cooper
(74) *Attorney, Agent, or Firm* — Kaplan Breyer Schwarz, LLP

(57) ABSTRACT

A slide assembly for a pistol includes a slide, a firing pin, a firing pin spring and a firing pin retainer. The firing pin retainer includes left-side and right side flat surfaces disposed on the rails of the firing pin retainer on the top side. A rear sight is providing having a bottom side having a pair of threaded mounting holes. A pair of threaded mounting fasteners each having a head is provided to mount the sight on the slide. A pair of threaded mounting holes of the slide is coaxial with the threaded mounting holes of the rear sight, wherein the threaded mounting fasteners extend through the rear sight mounting holes in the slide and into the pair of mounting holes in the rear sight, wherein, when the firing pin retainer is fully seated in the grooves of the slide, the heads of the fasteners are captured by the flat surfaces of the firing pin retainer.

5 Claims, 8 Drawing Sheets

SLIDE HAVING REAR SIGHT FASTENER ASSEMBLY FOR PISTOLS

FIELD OF THE INVENTION

The present invention relates to firearms. More particularly, the present invention is directed to rear sight attachments for pistols.

BACKGROUND OF THE INVENTION

Firearms owners often have the need for a precision optic or sighting system for their pistols. Traditional iron sights are often not accurate or precise enough at distance as compared with rifle style scopes and optics. The need for a red dot or small precision optic on a handgun have long been available. However, semi-automatic handguns often lack a reliable permanent mount which keeps the red dot, laser, or optic locked with a slide of the semi-automatic handgun.

Current rear sight attachment methods for a red dot optic or other optical aiming device include either utilizing a pre-cut slide to fit a specific optic or by utilizing a single dove tail attachment method with two single screws threaded into the rear open sight dovetail slot. With respect to the latter, a single dovetail mounting method may not be secure as that method may allow the optic to move or detach from the handgun slide. While a single dovetail attachment method provides a removable mount and does not require machining of the handgun slide, the method, nevertheless, may allow the red dot or accurate sighting device to drift front to rear thus losing its exact point of aim.

It is desirable to offer, integrated into modern pistol slides, mounting features for the installation of optical devices as well as offer a cover plate for use when an optic is not installed. The use of screw fasteners on the rear sight offers an easy and user configurable and reconfigurable solution for implementation of all of these features (as opposed to dovetail mounting of the rear sight) but the use of screws in such a way can be problematic were the fasteners to loosen from recoil and be allowed to fall into the inner workings of the pistol. The following invention offers a novel approach to capturing rear sight fasteners.

SUMMARY OF THE INVENTION

The present invention is directed to a slide assembly for a semi-automatic pistol. The slide assembly includes a firing pin having a hammer end and a striking end, and a firing pin spring coaxial to the firing pin. The slide assembly further includes a slide having a top side, a bottom side, a barrel end, a hammer end, and a longitudinal axis. The slide includes a pair of rear sight mounting holes disposed through the top side of the slide perpendicular to the longitudinal axis and adjacent to the hammer end, an aperture in the hammer end of the slide, parallel to the longitudinal axis, to receive the firing pin and the firing pin spring, and a left side vertical groove and a right side vertical groove at the hammer end of the slide and adjacent to the aperture. A firing pin retainer is disposed at the hammer end of the slide to retain the firing pin and the firing pin spring in the aperture of the slide. The firing pin retainer has a top side, a left side, a right side, a front surface, and a rear surface. The firing pin retainer includes an aperture to receive the hammer end of the firing pin where the aperture extends between the front surface and the rear surface of the firing pin retainer and is coaxial to the firing pin. A left-side rail is disposed on the firing pin retainer for receipt in the left side vertical groove of the slide and a right-side rail is disposed on the firing pin retainer for receipt in the right-side vertical groove of the slide.

A left-side flat surface is disposed on the left side rail on the top side and extends from the front surface to the rear surface of the firing pin retainer and parallel to the longitudinal axis of the slide. A right-side flat surface is disposed on the right-side rail adjacent to the top side and extends from the rear surface of the firing pin retainer and parallel to the longitudinal axis of the slide. A rear sight is provided having a bottom side having a pair of threaded mounting holes thereon. A pair of threaded mounting fasteners each having a head is provided.

The rear sight is disposed on the top side of the slide, wherein the pair of rear sight mounting holes of the slide are coaxial with the threaded mounting holes of the rear sight, wherein the threaded mounting fasteners extend through the pair of rear sight mounting holes in the slide and into the pair of mounting holes in the rear sight, wherein, when the firing pin retainer is fully seated in the left side vertical groove and the right side vertical groove of the slide, the heads of the threaded mounting fasteners are captured by the left-side flat surface and the right-side flat surface of the firing pin retainer.

The slide may include at least one additional aperture in the top side to secure an optic or optic adapter plate. The slide may include a dovetail groove in the barrel end for receipt of a front sight. The threaded fasteners may include star washers. In an exemplary embodiment, the threaded fasteners are socket head cap screws.

DETAILED DESCRIPTION

Figure 1:
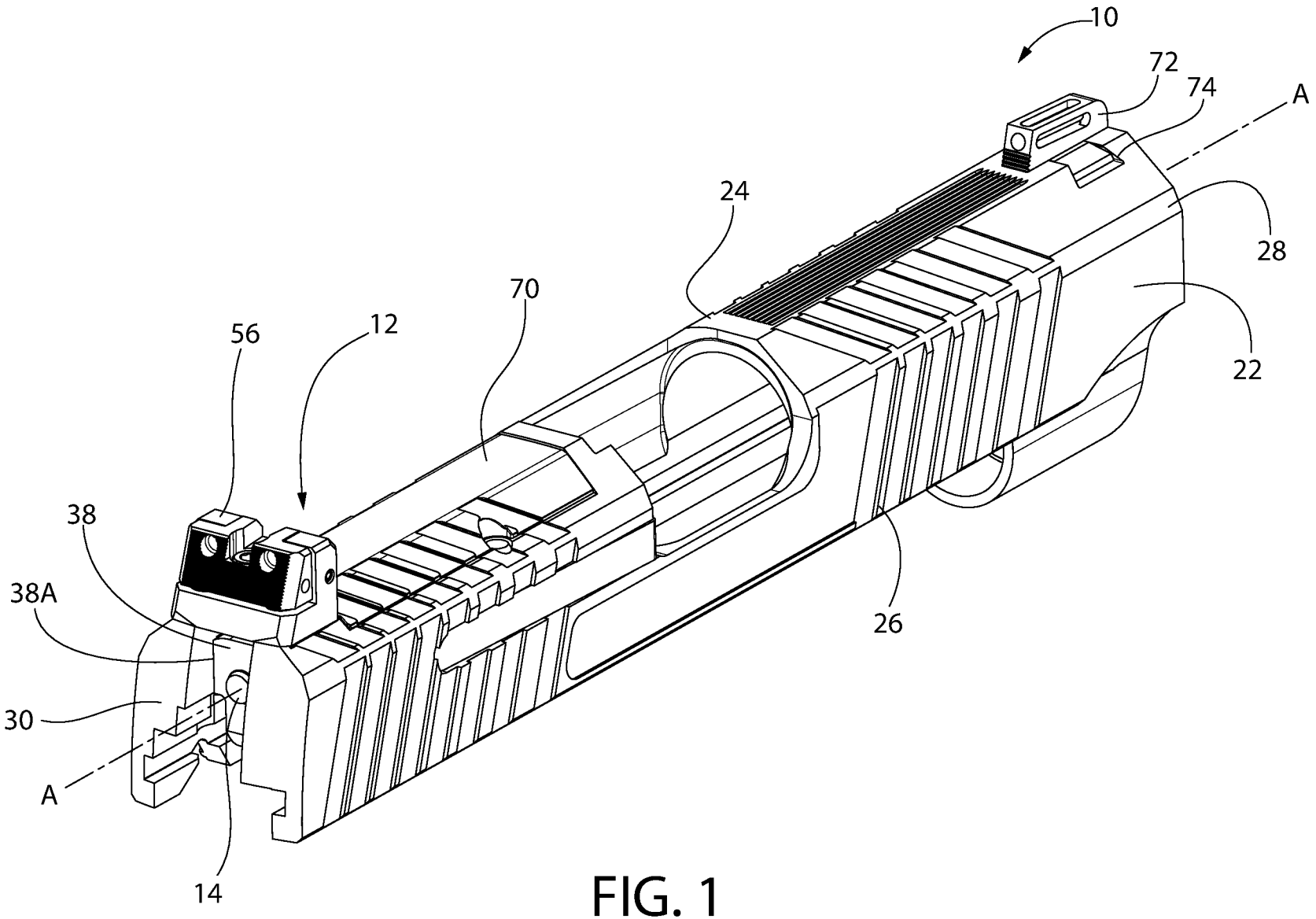
FIG. 1 is a top, isometric view of a slide assembly having a rear sight fastener assembly for pistols in accordance with an exemplary embodiment of the present invention.
Figure 2:
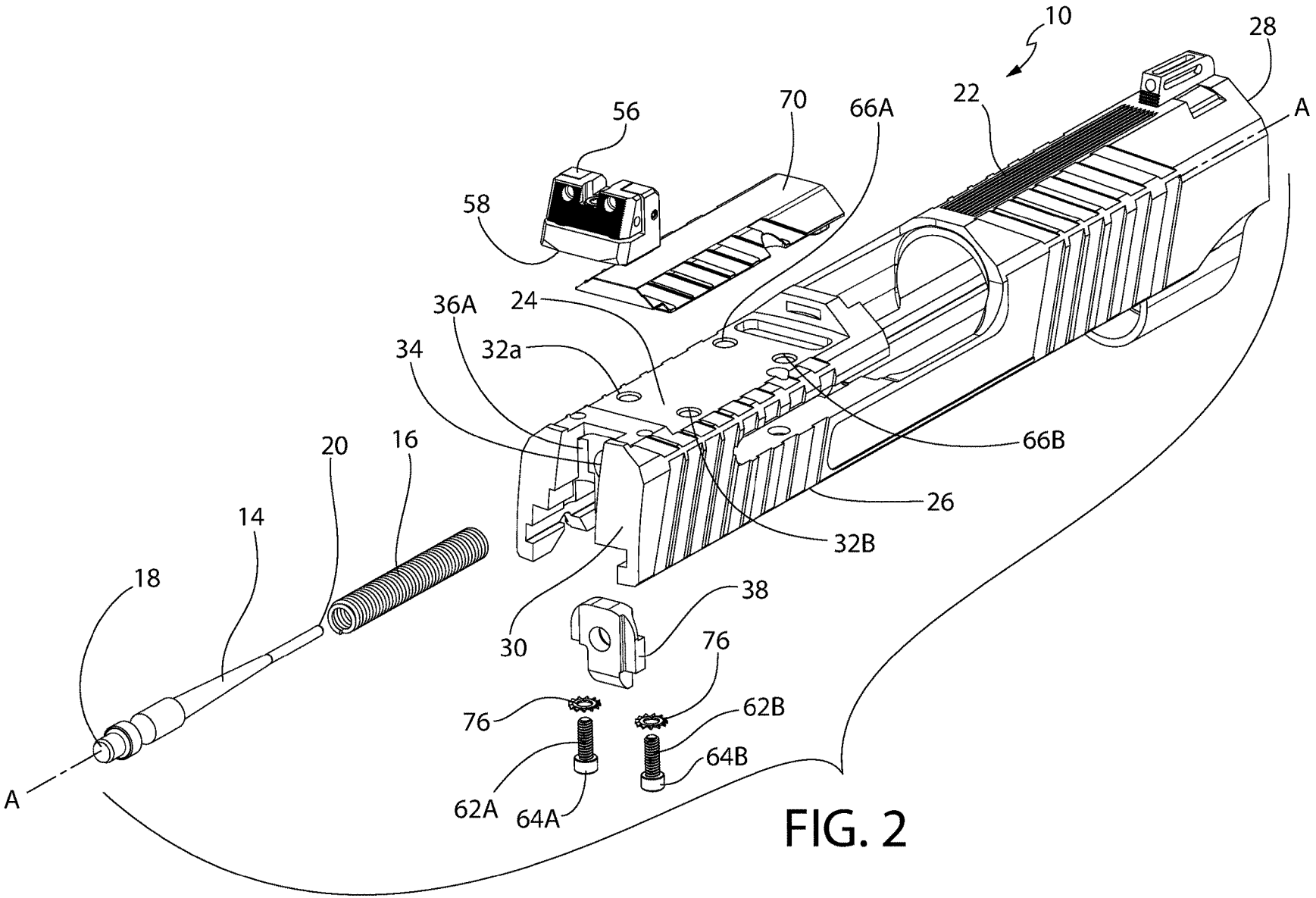
FIG. 2 is an exploded, top isometric view of the slide assembly of FIG. 1.
Figure 3:
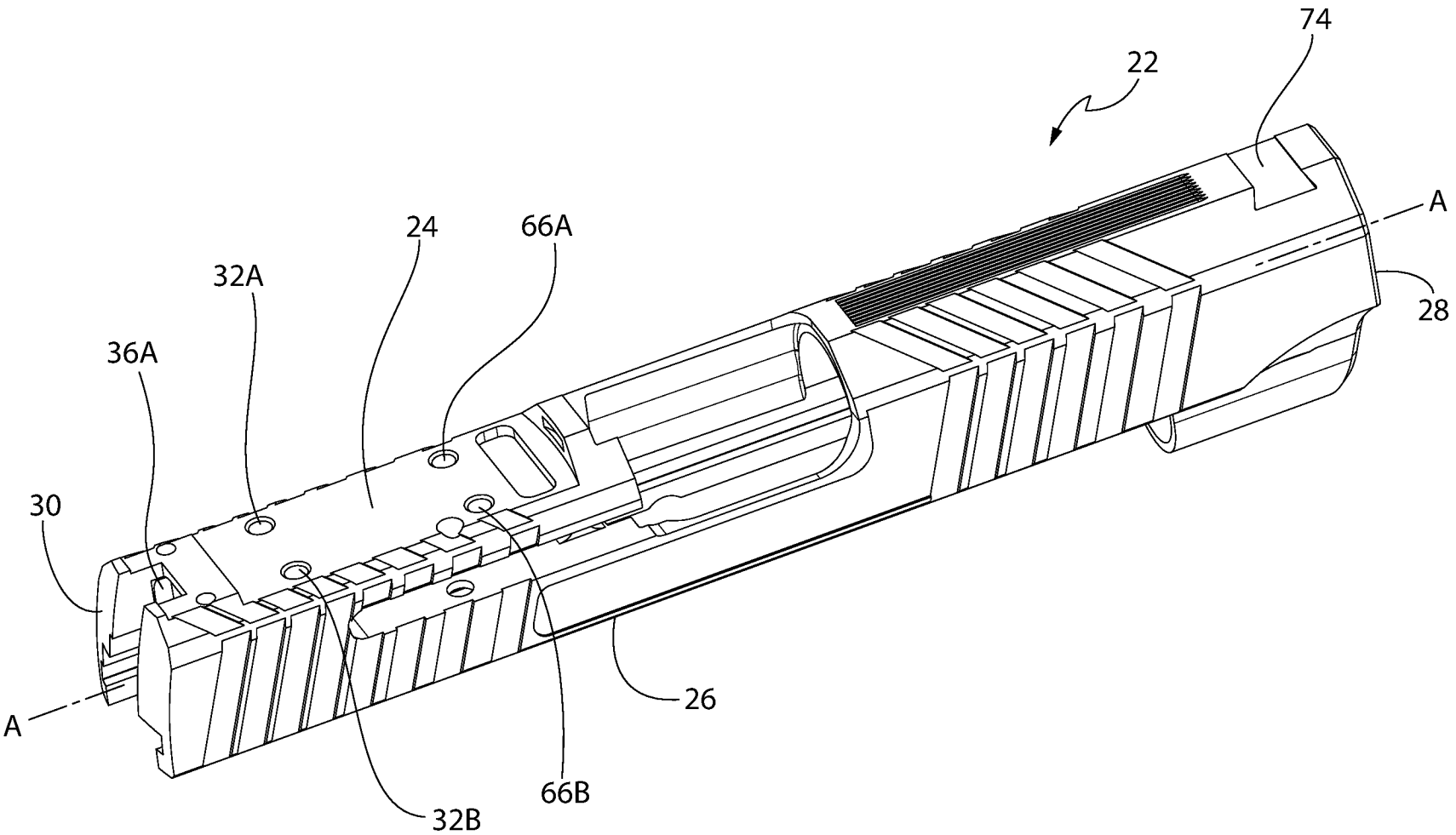
FIG. 3 is a top, isometric view of a slide of the slide assembly of FIG. 1.
Figure 5:
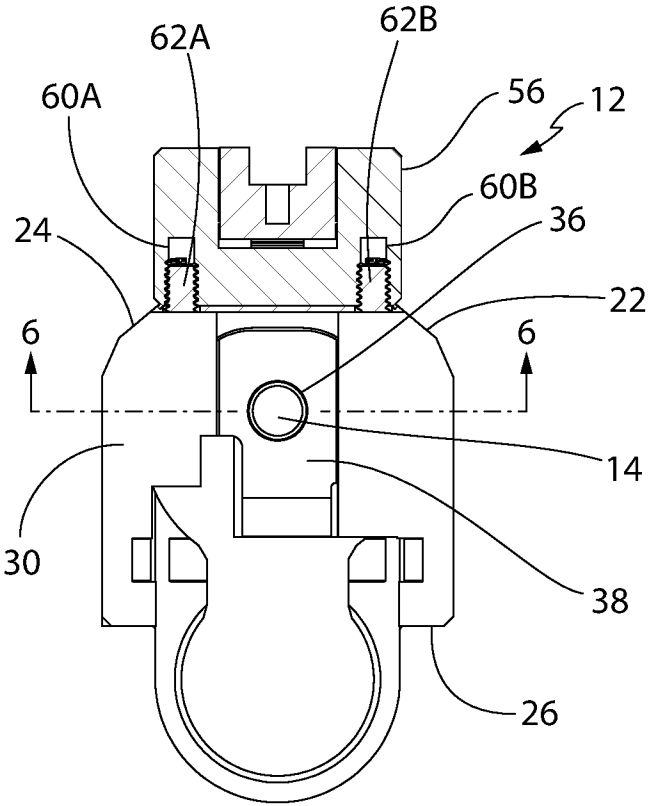
FIG. 5 is a rear elevation view of the slide assembly of FIG. 1, shown with a vertical cross-sectional view of a rear sight, taken through its threaded mounting holes.
Figure 7:
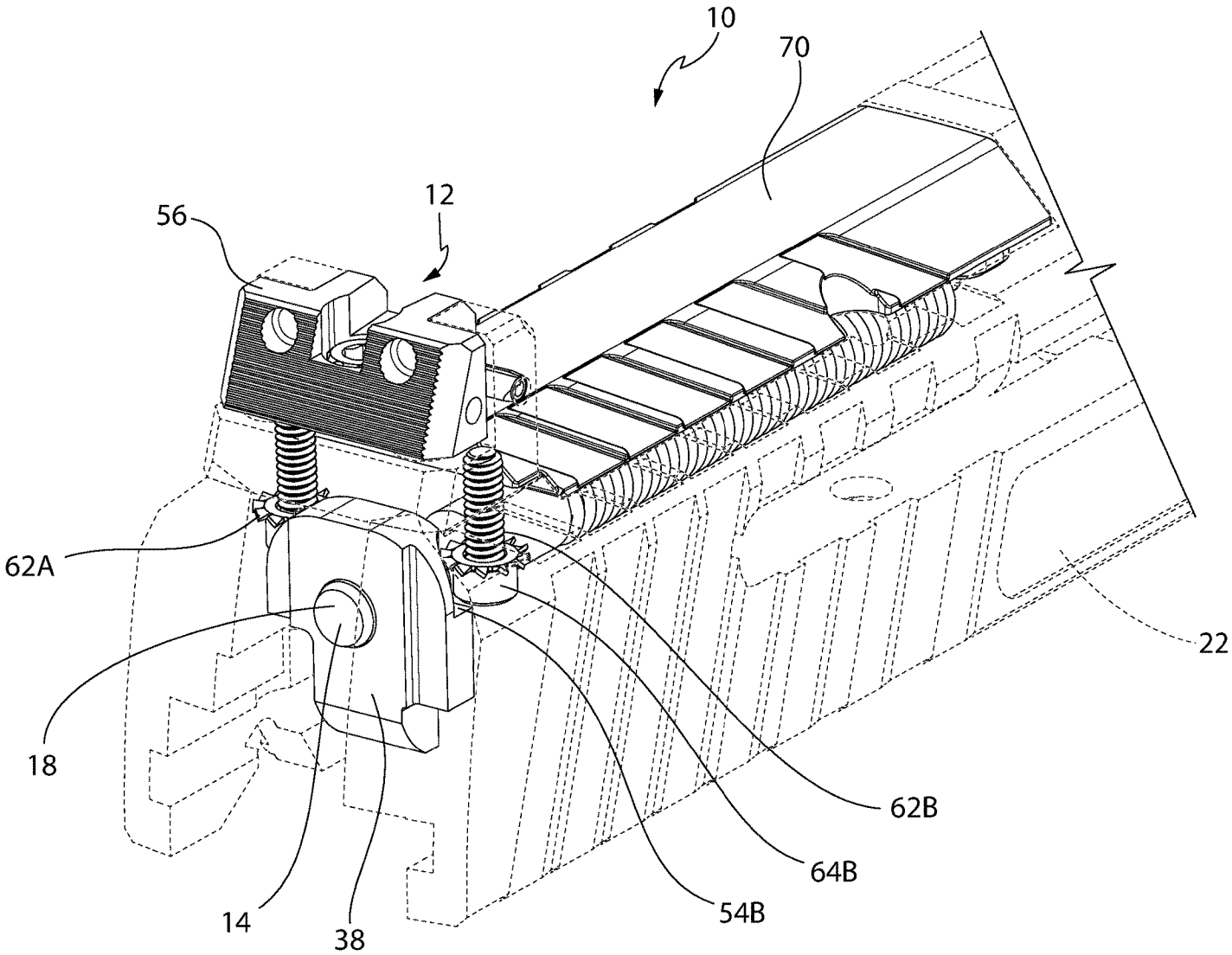
FIG. 7 is a top isometric view of a rear sight, firing pin retainer and miscellaneous hardware of the slide assembly of FIG. 1, shown with the slide of FIG. 3 in broken lines.
Figure 8:
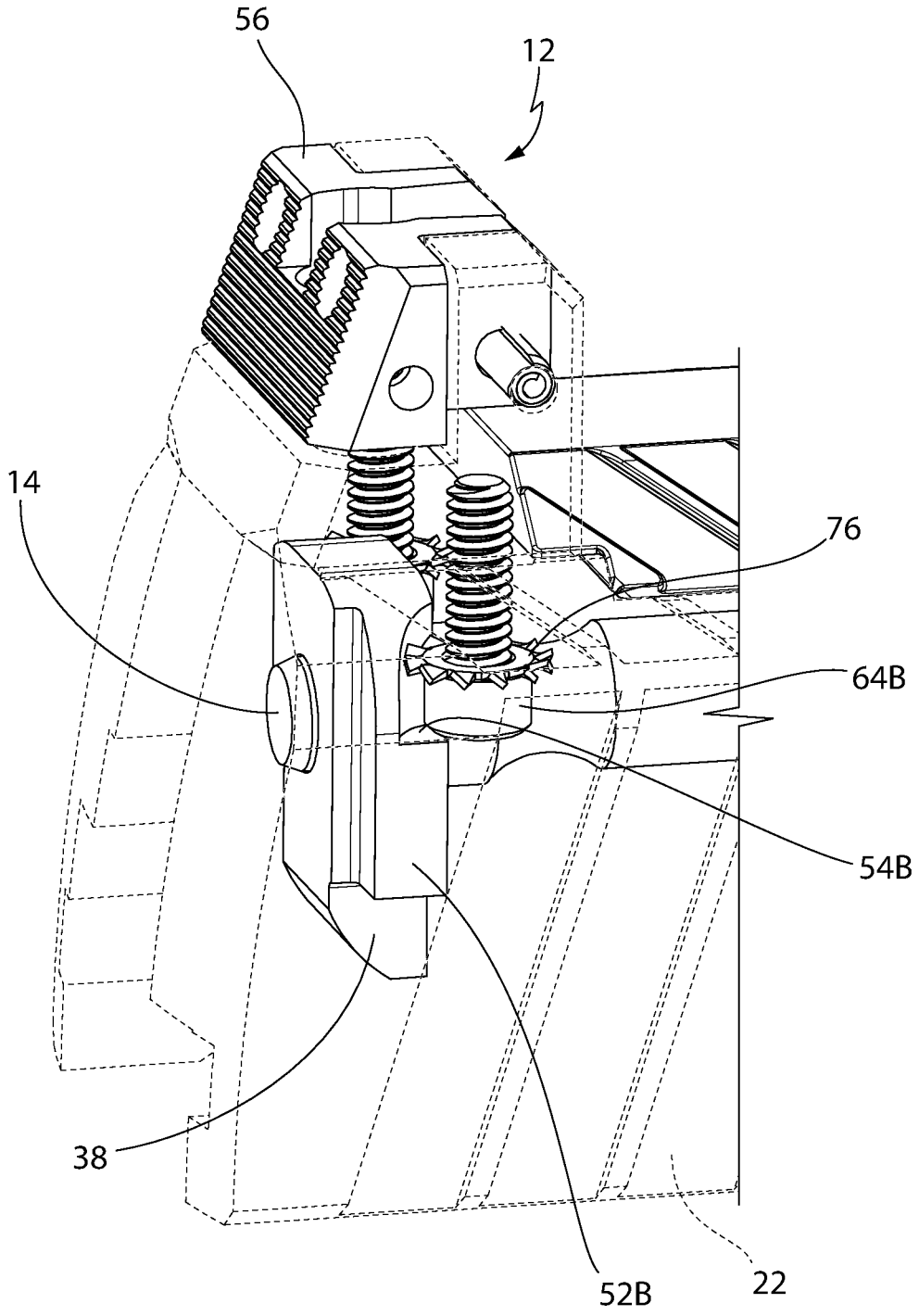
FIG. 8 is a side isometric view of the rear sight, firing pin retainer and associated hardware of the slide assembly of FIG. 1, shown with the slide of FIG. 3 in broken lines.
Figure 9:
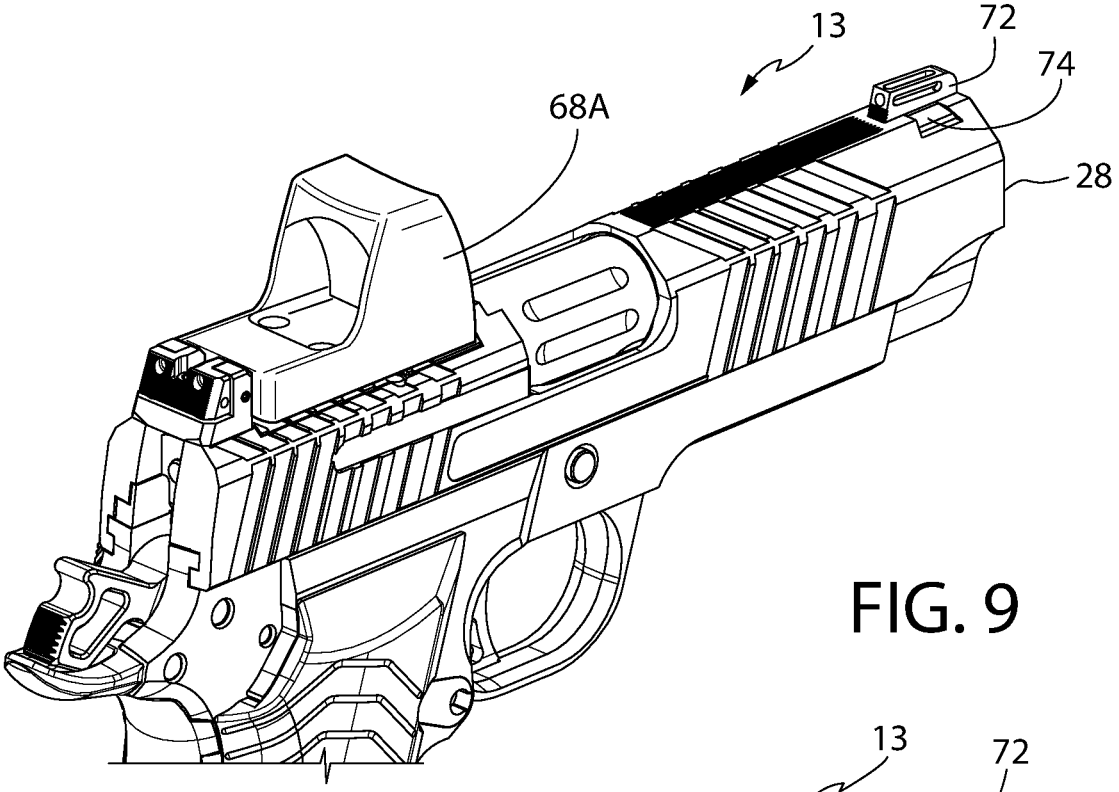
FIG. 9 is a side isometric view of a firearm including the slide assembly of FIG. 1, shown with a first optional optic assembly.
Figure 10:
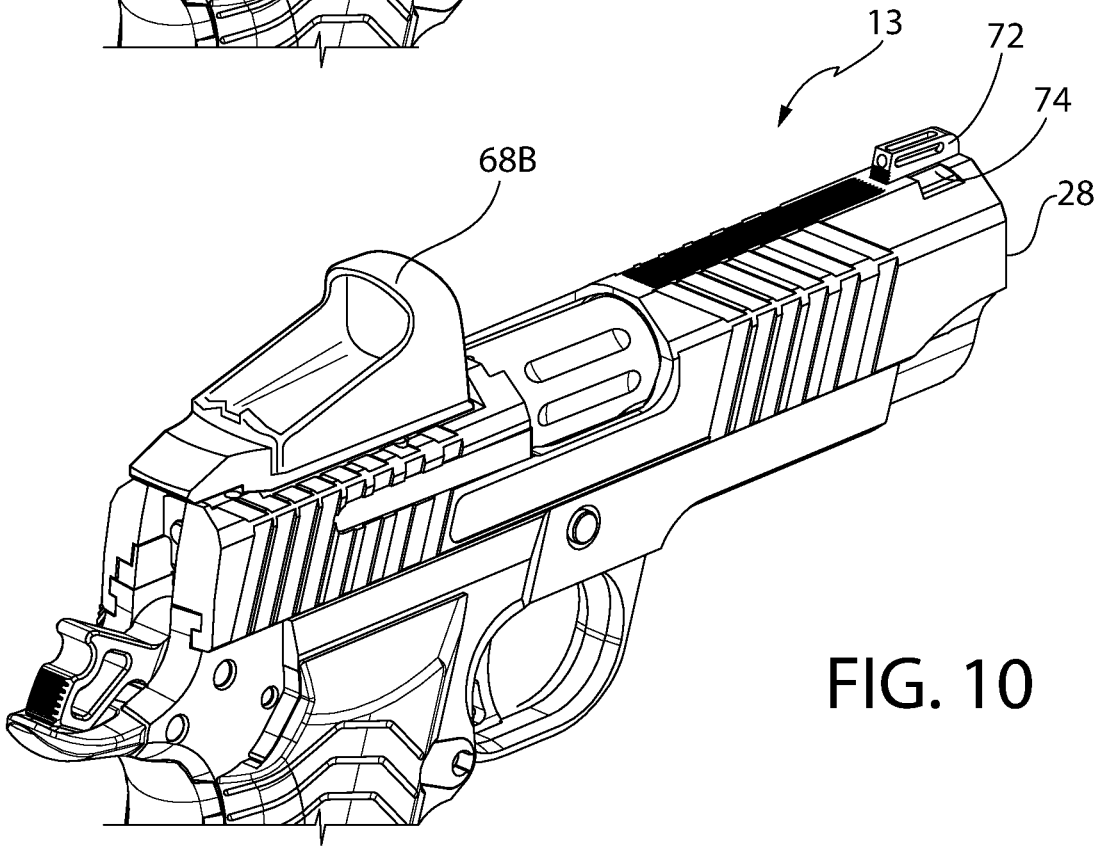
FIG. 10 is a side isometric view of a firearm including the slide assembly of FIG. 1, shown with a second optional optic assembly.

Referring now to the drawing figures wherein like reference numbers refer to like elements throughout the several views, there is shown in FIG. 1 a slide assembly 10 having a rear sight fastener assembly 12 (including rear sight 56, fasteners 62A, 62B, firing pin retainer 38 and portion of slide 22, described below; See FIGS. 5, 7 and 8) for a semi-automatic pistol 13 (see FIGS. 9 and 10) in accordance with an exemplary embodiment of the present invention. As can be seen in the exploded view of FIG. 2, the slide assembly 10 includes a slide 22, a firing pin 14 and a firing pin spring 16. The firing pin 14 has a hammer end 18 and a striking end 20. The slide assembly 10 includes the slide 22 having a top side 24, a bottom side 26, a barrel end 28, a hammer end 30, and a longitudinal axis A. See FIG. 3.

Figure 6:
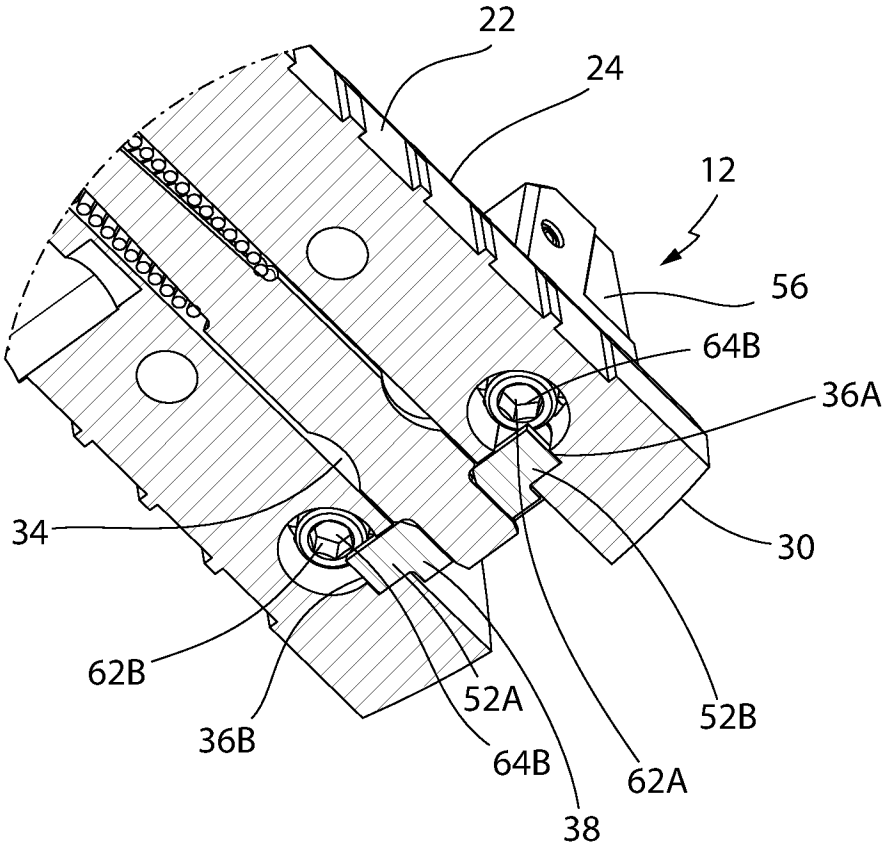
FIG. 6 is a cross-sectional view of the slide assembly of FIG. 1, taken substantially along lines 6-6 of FIG. 5.

The slide 22 has a pair of rear sight mounting holes 32A, 32B disposed through the top side 24 of the slide 22 perpendicular to the longitudinal axis A and adjacent to the hammer end 30 of the slide. The slide 22 further includes an aperture 34 in the hammer end 30 to receive the firing pin 14 and the firing pin spring 16 in the usual manner for 1911 style pistols. A left-side vertical groove 36A and a right-side vertical groove 36B are disposed at the hammer end 18 of the slide 22 adjacent to the aperture 34. See, for example, FIG. 6. Again, similar grooves are present and well known to those skilled in the art of 1911 style pistols.

Figure 4B:
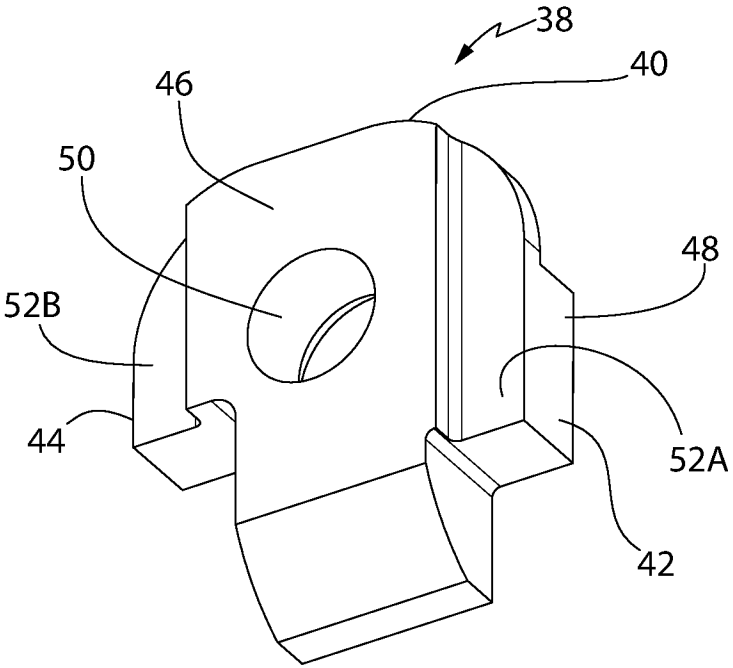
FIG. 4B is a rear side isometric view of the firing pin retainer of FIG. 2A.
Figure 4A:
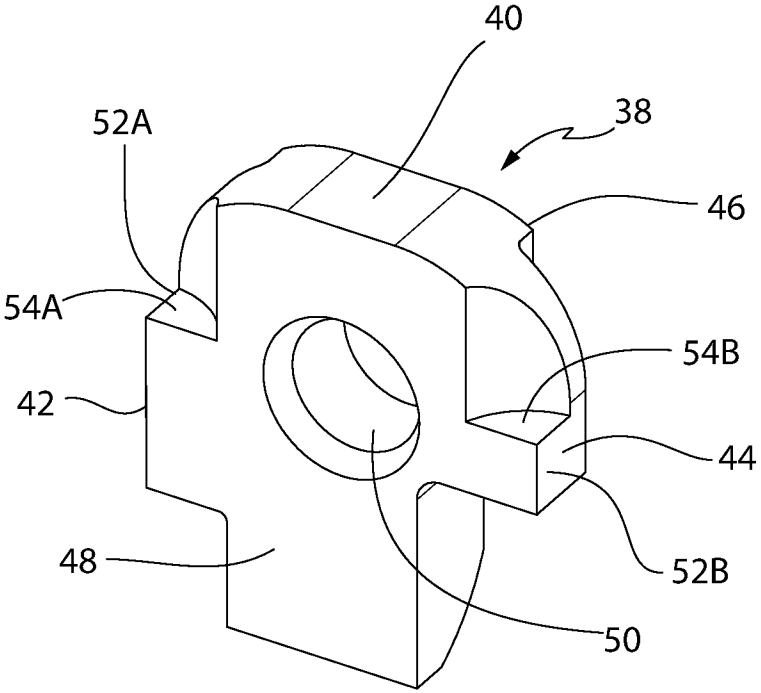
FIG. 4A is a front side isometric view of a firing pin retainer of the rear sight fastener assembly of FIG. 1.

A firing pin retainer 38 is disposed at the hammer end 18 of the slide 22 to retain the firing pin 14 and the firing pin spring 16 in the aperture 34 of the slide 22. See FIGS. 4A and 4B. The firing pin retainer 38 has a top side 40, a left side 42, a right side 44, a front surface 46 and a rear surface 48. The firing pin retainer 38 includes an aperture 50 to receive the hammer end 18 of the firing pin 14. The aperture 50 extends between the front surface 46 and the rear surface 48 of the firing pin retainer 38 and is coaxial to the firing pin 16. Again, except for the modifications described herein, 1911 style pistols typically have firing pin retainers of the general type described here. The firing pin retainer 38 further includes a left-side rail 52A for receipt in the left side vertical groove 36A and a right-side rail 52B for receipt in the right-side vertical groove 36B. A left-side flat surface 54A is disposed on the left side rail 52A adjacent to the top side 40 of the firing pin retainer 38. The left-side flat surface 54A extends from the rear surface 48 of the firing pin retainer 38 and is parallel to the longitudinal axis A of the slide 22. A right-side flat surface 54B is disposed on the right-side rail 52B adjacent to the top side 24 of the firing pin retainer 38. The right-side flat surface 54B extends from the rear surface 48 of the firing pin retainer 38 and is parallel to the longitudinal axis A of the slide 22.

A rear sight 56 is included having a bottom side 58 having a pair of threaded mounting holes 60A, 60B thereon. Finally, a pair of threaded mounting fasteners 62A, 62B is included, each having a head 64A, 64B.

The rear sight 56 is disposed on the top side 24 of the slide 22, wherein the pair of rear sight mounting holes 32A, 32B of the slide 22 is coaxial with the threaded mounting holes 60A, 60B of the rear sight 56. The threaded mounting fasteners 62A, 62B extend through the pair of rear sight mounting holes 32A, 32B in the slide 22 and into the pair of mounting holes 60A, 60B in the rear sight 56.

The firing pin 14 and the firing pin spring 16 are retained in the aperture 34 of the slide 22 by inserting the firing pin 14 and the firing pin spring 16 into the aperture 34 and then sliding the firing pin retainer 38 into position perpendicular to the longitudinal axis A of the slide 22, utilizing the rails 52A, 52B of the firing pin retainer 38 engaging the rails 52A, 52B, until the hammer end 18 of the firing pin 14 snaps into its seated position in the aperture 34 of the firing pin retainer 38.

When the firing pin retainer 38 is fully seated in the left side vertical groove 36A and the right-side vertical groove 36B of the slide 22, the heads 64A, 64B of the threaded mounting fasteners 62A, 62B are captured by the left-side flat surface 54A and the right-side flat surface 54B of the firing pin retainer 38. Star washers 76, as shown, may be used to aid in fastening. In the exemplary embodiment the threaded mounting fasteners 62A, 62B may be socket head cap screws.

The slide assembly 10 may include slide 22 having at least one additional aperture 66A, 66B in the top side 24 to secure an optic 58 or optic adapter plate 70. The slide 22 may have a dovetail groove 74 on the top side 24 adjacent to the barrel end 28 for installation of a front sight 72.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A slide assembly for a semi-automatic pistol comprising:

(a) a firing pin having a hammer end and a striking end;

(b) a firing pin spring coaxial to the firing pin;

(c) A slide having a top side, a bottom side, a barrel end, a hammer end, and a longitudinal axis, the slide comprising:

(i) a pair of rear sight mounting holes disposed through the top side of the slide perpendicular to the longitudinal axis and adjacent to the hammer end;

(ii) an aperture in the hammer end of the slide, parallel to the longitudinal axis, to receive the firing pin and the firing pin spring;

(iii) a left side vertical groove and a right side vertical groove at the hammer end of the slide and adjacent to the aperture;

(d) a firing pin retainer disposed at the hammer end of the slide to retain the firing pin and the firing pin spring in the aperture of the slide, the firing pin retainer having a top side, a left side, a right side a front surface and a rear surface, the firing pin retainer comprising:

(i) an aperture to receive the hammer end of the firing pin, the aperture extending between the front surface and the rear surface of the firing pin retainer and coaxial to the firing pin;

(ii) a left-side rail for receipt in the left side vertical groove and a right-side rail for receipt in the right-side vertical groove;

(iii) a left-side flat surface disposed on the left side rail on the top side, the left-side flat surface extending from the front surface to the rear surface of the firing pin retainer and parallel to the longitudinal axis of the slide;

(iv) a right-side flat surface disposed on the right-side rail adjacent to the top side, the right-side flat surface extending from the rear surface of the firing pin retainer and parallel to the longitudinal axis of the slide;

(e) a rear sight having a bottom side having a pair of threaded mounting holes thereon;

(f) a pair of threaded mounting fasteners each having a head;

wherein the rear sight is disposed on the top side of the slide, wherein the pair of rear sight mounting holes of the slide are coaxial with the threaded mounting holes of the rear sight, wherein the threaded mounting fasteners extend through the pair of rear sight mounting holes in the slide and into the pair of mounting holes in the rear sight, wherein, when the firing pin retainer is fully seated in the left side vertical groove and the right side vertical groove of the slide, the heads of the threaded mounting fasteners are captured by the left-side flat surface and the right-side flat surface of the firing pin retainer.

2. The slide assembly of claim 1, wherein the slide includes at least one additional aperture in the top side to secure an optic or optic adapter plate.

3. The slide assembly of claim 1, wherein the slide includes a dovetail groove in the barrel end for receipt of a front sight.

4. The slide assembly of claim 1, herein the threaded fasteners include star washers.

5. The slide assembly of claim 1, wherein the threaded fasteners are socket head cap screws.

* * * * *